US005325802A

United States Patent [19]

Stutznäcker

[11] Patent Number: 5,325,802

[45] Date of Patent: Jul. 5, 1994

[54] SEWING MACHINE FOR LARGE-SURFACE, FRAME CLAMPED MATERIAL

[75] Inventor: Klaus Stutznäcker, Frechen, Fed. Rep. of Germany

[73] Assignee: Nähmaschinenfabrik Emil Stutznäcker GmbH & Co. KG, Fed. Rep. of Germany

[21] Appl. No.: 910,810

[22] Filed: Jul. 9, 1992

[30] Foreign Application Priority Data

Jul. 20, 1991 [DE] Fed. Rep. of Germany ..... 4124194

[51] Int. Cl.[5] ..... D05B 11/00

[52] U.S. Cl. ..... 112/117; 198/470.1

[58] Field of Search ..... 112/117, 118, 119; 198/465.3, 470.1, 472.1

[56] References Cited

U.S. PATENT DOCUMENTS

| | | | |
|---|---|---|---|
| 3,044,426 | 7/1962 | Schwarzberger | 112/117 |
| 3,070,049 | 12/1962 | Kalning | 112/117 |
| 3,124,256 | 3/1964 | Schwarzberger | 112/118 X |
| 3,180,293 | 4/1965 | Cash | 112/118 |
| 3,382,825 | 5/1968 | Cash | 112/117 |
| 3,884,344 | 5/1975 | Hurst | 198/472.1 |
| 4,420,051 | 12/1983 | Furuta et al. | 198/465.3 X |
| 4,649,842 | 3/1987 | Bäckmann | 112/117 X |

FOREIGN PATENT DOCUMENTS

| | | |
|---|---|---|
| 1131496 | 7/1960 | Fed. Rep. of Germany . |
| 2938064 | 9/1979 | Fed. Rep. of Germany . |
| 3321749 | 6/1983 | Fed. Rep. of Germany . |

*Primary Examiner*—Clifford D. Crowder
*Assistant Examiner*—Paul C. Lewis
*Attorney, Agent, or Firm*—Diller, Ramik & Wight

[57] ABSTRACT

The invention concerns a sewing machine for a large-surface, frame-clamped material.

Sewing machines for large-surface materials 39 clamped in a frame 38, 50 are known, wherein the material 39 is held in place in stationary manner in a sewing-machine structure 1, the sewing head together with the gripper box being displaceable longitudinally and transversely and frame-exchanging equipment being provided.

In order to create a sewing machine with a much simplified design for the frame-exchanging equipment, the invention proposes that the frame-exchanging equipment be mounted in the vicinity of the sewing-machine structure 1 and comprise a conveyor of such design that following sewing, the frame 38 with the processed material 39 be forced out of the sewing-machine structure 1 and simultaneously the frame 50 with the material to be processed be pulled-in and be moved into the sewing position, and in that the two frames 38, 50 be moved overlapping one with the other during the exchange.

31 Claims, 5 Drawing Sheets

VII
VII
M

SEWING MACHINE FOR LARGE-SURFACE, FRAME CLAMPED MATERIAL

BACKGROUND OF THE INVENTION

The invention concerns a sewing machine for large-surface, frame-clamped material held in place during sewing in a sewing-machine structure, the sewing head together with the gripper box being displaceable both transversely and longitudinally, and comprising frame-exchanging equipment.

Sewing machines for large-surface, frame-clamped material, for instance quilts, and comprising frame-exchanging equipment, are known for instance from U.S. Pat. Nos. 3,180,293; 3,382,835 and from the German patent 1,131,496. Such known machinery always entails unusually high expenditures for the frame-exchanging equipment mainly because complex lifting and shifting apparatus are provided not only at the sewing structure proper, but also at a preceding loading bench, said apparatus serving to raise the exchange frames together with the material to different heights, whereupon the exchange frames are shifted individually and the exchange is carried out. As regards the machines of the above documents, moreover, costs also are very large because the frame together with the material is displaced during sewing in the sewing machine proper in the longitudinal and transverse directions according to the pattern. Operators must constantly be present to monitor frame-exchange.

SUMMARY OF THE INVENTION

On the other hand it is the object of the present invention to create a sewing machine of which the costs relating to the frame-exchanging equipment are substantially reduced and which facilitates operation and maintenance.

This problem is solved by the invention in that the frame-exchanging equipment is mounted near the sewing-machine structure and comprises a conveyor designed in such a way that following sewing, the frame with the processed material is expelled from the sewing-machine structure and simultaneously the frame with the material to be processed is pulled-in and moved into the sewing position, and in that the two frames are moved in mutually overlapping manner during the changeover.

Advantageous embodiments of the sewing machine of the invention are stated in the sub-claims.

The drawing schematically shows an illustrative embodiment of the invention.

DESCRIPTION OF THE PREFERRED EMBODIMENT

Figure 7:
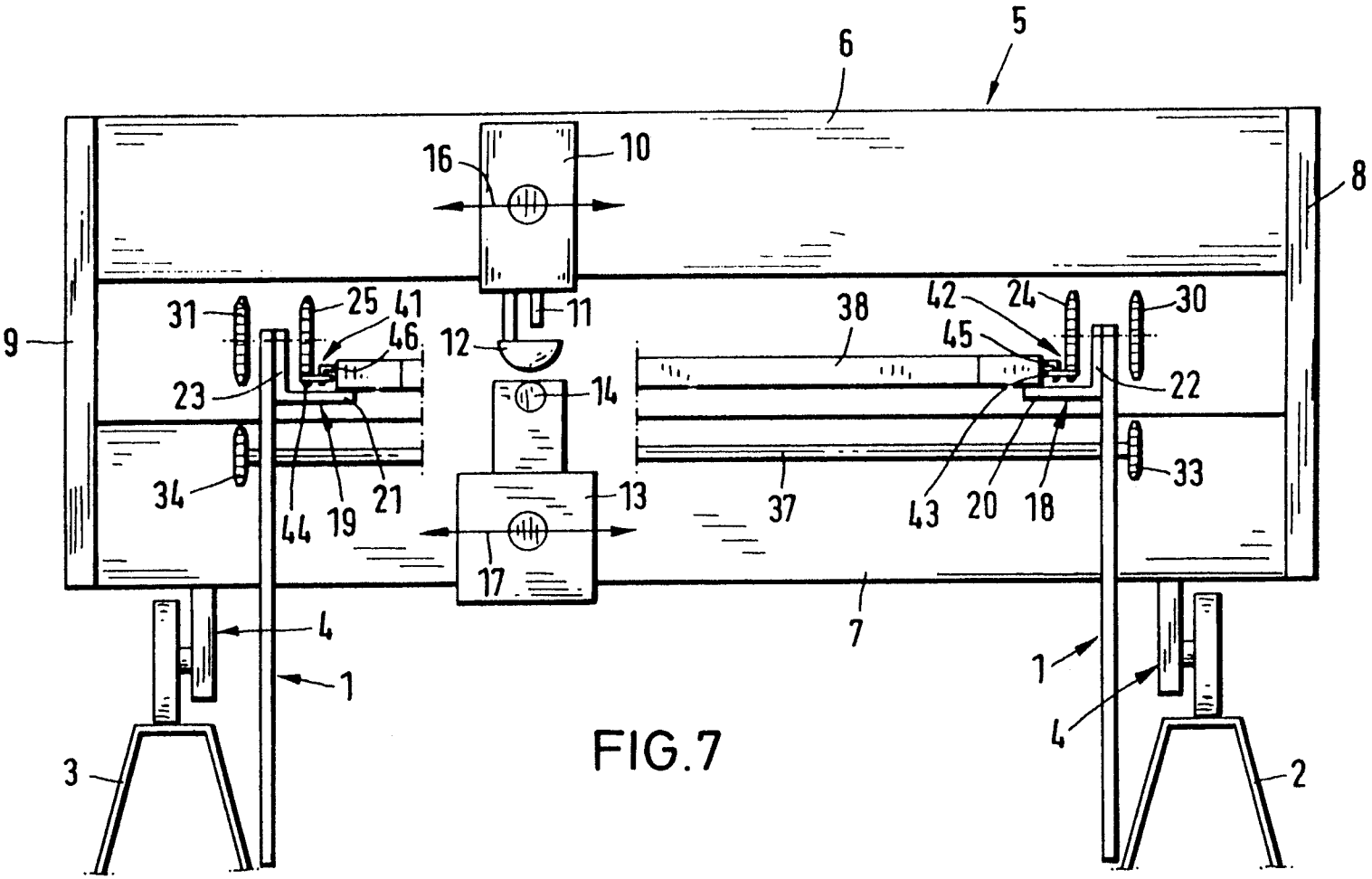
FIG. 7 is a simplified, enlarged vertical section relating to FIG. 1 along the section line VII—VII.
Figure 8:
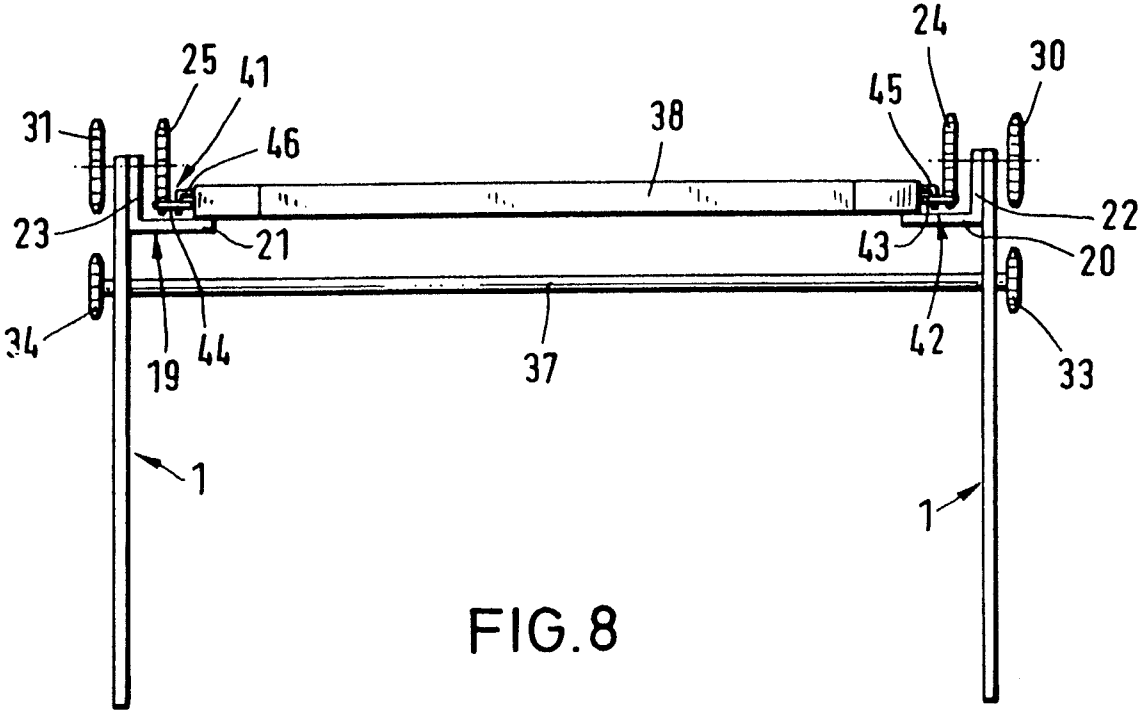
FIG. 8 is a dètail complementing FIG. 7.

The drawings show a sewing machine with a simplified machine structure 1 essentially consisting of posts at the corners and reinforcing rails longitudinally and transversely between the posts, in one instance near the ground and in the other in the upper post zone. Moreover there are two travel rails 2, 3 on the ground or in the lower zone of the sewing-machine structure that allow the to-and-fro displacement of carriages 4 in the longitudinal direction of the sewing-machine structure as indicated by the arrow 15. The carriages support a frame-like portal 5 with an upper crossbeam 6, a lower crossbeam 7 and two side boxes 8 and 9 (FIG. 7). A sewing head 10 with needle holder 11 and press foot 12 as well as a gripper box 13 comprising grippers 14 are displaceable in this portal in the directions of the arrows 16 and 17, that is transversely to the sewing-machine structure, and consequently an arbitrary pattern can be made on the stationary material, for instance a quilt.

Two longitudinal guides 18 and 19 with rest surfaces 20 and 21 for the frames 38 and 50 resp. and subsequently described are affixed to the upper part of the machine structure. Advantageously these guides consist of mutually spaced and parallel L-shaped guide rails of which the lower horizontal legs 20 and 21 resp. form the rest surfaces and of which the vertical legs 22 and 23 pivotably support reversing rollers or sprocket wheels 24, 25, 26 and 27. Two lateral endless belts or chains are guided around these reversing rollers or sprocket wheels 24 through 27. Because the rotation shafts are affixed horizontally to the vertical legs 22 and 23, each endless belt forms an upper and a lower belt side. Instead of belts, preferably fine-link chains may be used, as a result of which the teeth of the pertinent sprocket wheels enter the gaps between the links.

The endless belts or chains 28 and 29 are fitted with coupling means 43, 44, 47 and 48 cooperating with further coupling means 45, 46, 52 and 53 mounted on the two exchange frames 38 and 50 resp. In the embodiment mode shown, the coupling means at the chains 28, 29 are horizontal bolts 43, 44, 47, 48 penetrating inward and the coupling means of the frames 38, 50 are claws 45, 46, 52, and 53 gripping the bolts. This is an especially simple design. However couplings denoted by 41 and 42 may be used instead, for instance in the form of magnetic locks or snap-connectors. The essential in this respect is to reliably hold and guide the coupled frames during the chain motion and that the frame in the operational position also be securely held during sewing. Advantageously the coupling means 45, 46, 52, 53 of the frames 38, 50 are mounted near the forward corners of the longitudinal frame sides, as made clear in particular by FIG. 2.

The endless belts or chains 28, 29 each consist of first upper and second lower generally parallel conveyor runs or portions and opposite bight conveyor runs or portions therebetween. In that case the two coupling means 43 or 44 and 47 or 48 are present at the bight conveyor runs or portions where the two sides merge into each other. The chains are not shown in FIG. 7. The coupling means 43 and 44 shown there therefore are affixed not to the reversing rollers or sprocket wheels 24 and 25 but to the omitted chains. The distance between the reversing rollers or sprocket wheels 24 and 26 and 25 and 27 exceeds the length of the frames 38 and 50.

Figure 3:
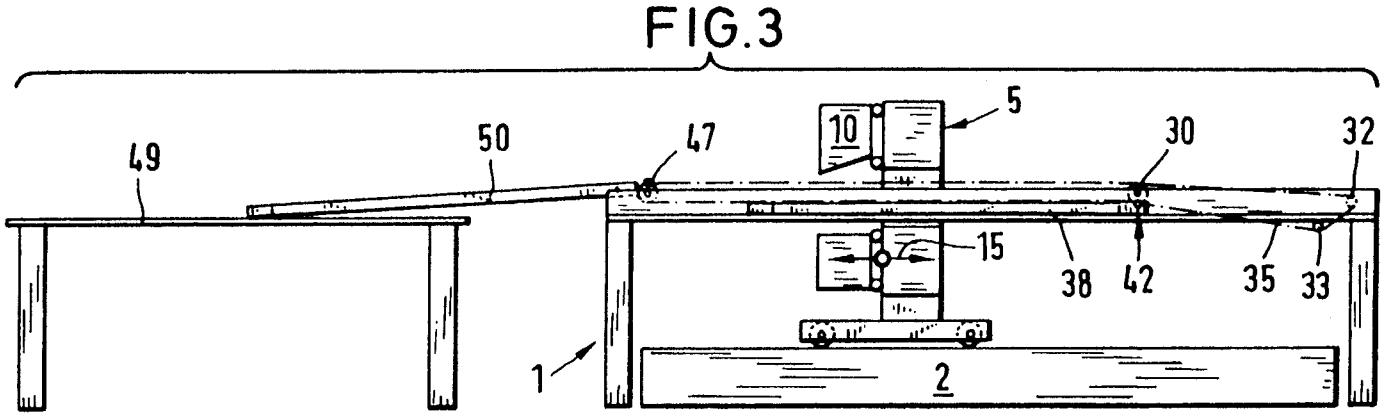
FIG. 3 is a sideview corresponding to FIG. 1, the exchange frame having been connected, i.e., coupled.

The endless belts or chains 28, 29 are controlled or so driven—each time in the direction of the arrow 54 for the upper side and 55 for the lower side (FIG. 1)—that one of the pairs of coupling means, namely the coupling means 47, 48 is located at the upper vertex of the front reversing rollers 26, 27 and the other pair of couplings means, namely the coupling means 43, 44 is present at the vertex of the rear reversing rollers 24, 25 when the belts or the chains are motionless, that is, during sewing. In this stationary position, the frame 50 together with the material 51 subtends a slight slope with a shallow angle relative to the horizontal and can be coupled, as shown by FIG. 3. The other frame 38 is kept in the horizontal operational position during said stationary position, as shown by FIGS. 1 and 3.

Figure 5:
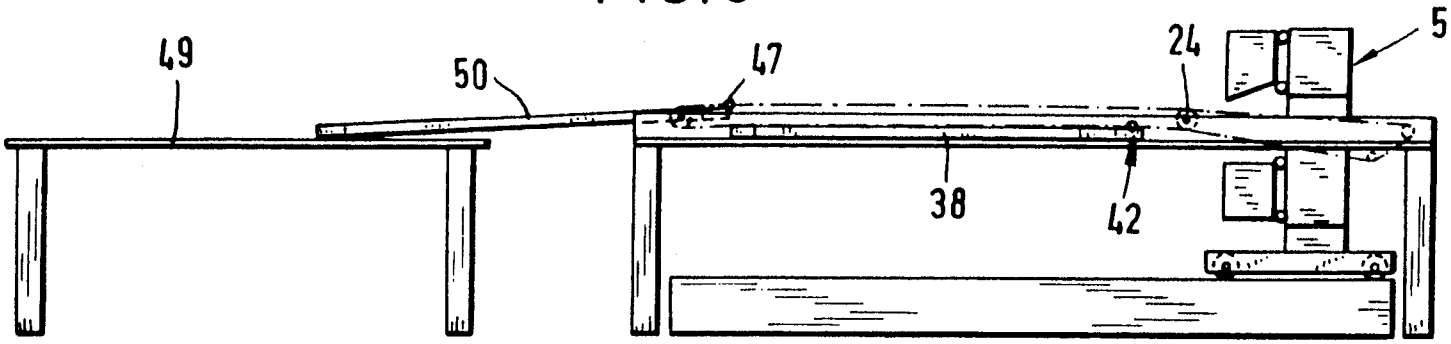
FIG. 5 is a sideview relating to FIGS. 1, 3 but for an intermediate position of the two mutually exchangeable frames.
Figure 6:
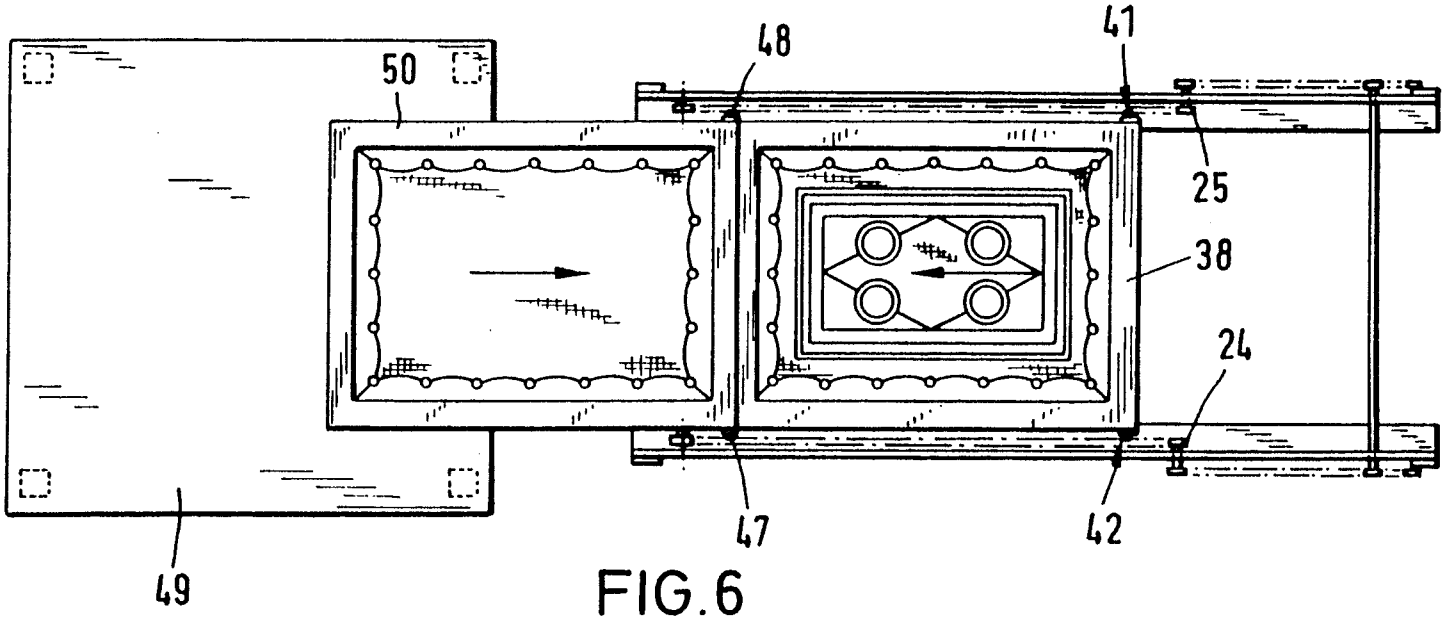
FIG. 6 is a topview relating to FIG. 5.

The motion of the endless belts or chains 28, 29 is so controlled during the frame exchange that the frame 38 with the processed material is horizontally and slidingly expelled on the rest surfaces 20, 21 of the guides 18, 19 while at the same time the frame 50 with the material to be processed is slidingly pulled-in at a slant over the other frame 38. FIGS. 5 and 6 illustrate a corresponding intermediate position during frame exchange.

The endless belts or chains 28, 29 are driven by a common drive, in particular a conventional geared electric motor M, with insertion of drive belts or chains 35 and 36 and of a drive shaft 37. These drive belts or chains 35 and 36 also are guided on reversing rollers 30, 31 and 32 and about tensioning rollers 33 and 34. Where chains are being used, these reversing rollers obviously are once more sprocket wheels or gears, the two sprocket wheels 30 and 31 being coaxially affixed to the rotation shafts of the reversing rollers or sprocket wheels 24, 25.

Figures 1, 2:
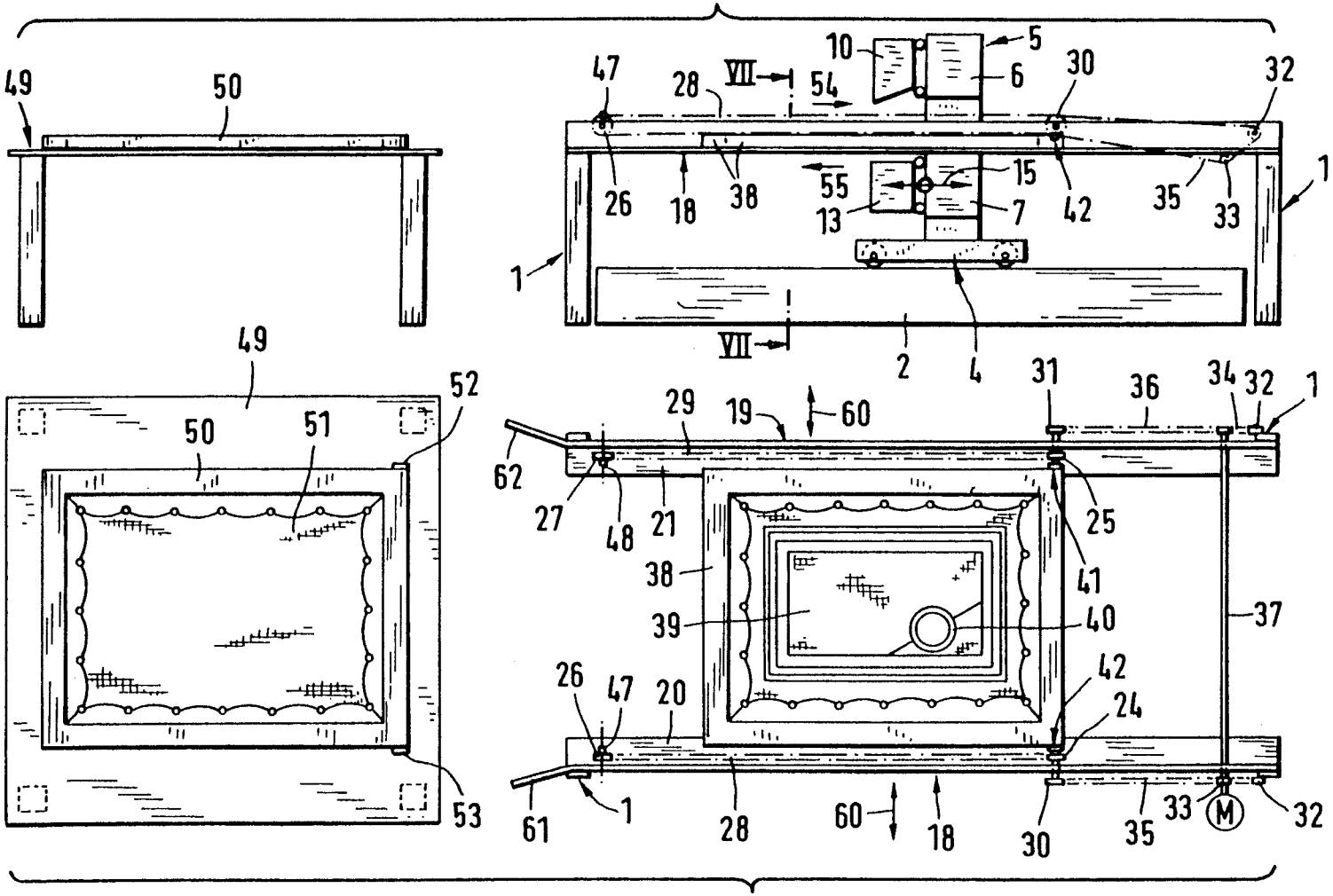
FIG. 1 is a sideview of a sewing machine, with one frame and the sewing machine proper being in the operational position.
FIG. 2 is a topview of FIG. 1, the portal and the sewing head having been omitted.

Advantageously an adjustment system diagrammatically indicated by the oppositely headed arrows 60 of FIG. 2, for instance in the form of simultaneously actuated spindles, shall be provided, to allow adjusting the distance between the guides 18, 19, so that frames of different sizes with correspondingly large material 39 with sewing patterns 40 may be used. Advantageously omitted guide components 61, 62 (FIG. 2) to facilitate the coupling of the particular frame 50 to the material 51 to be processed also may be provided in the vicinity of the front reversing rollers 26, 27 respectively. Such guides may be pivotable metal guides receiving the front corners of the frame 50 to be inserted, said front corners then being made to couple.

Figure 4:
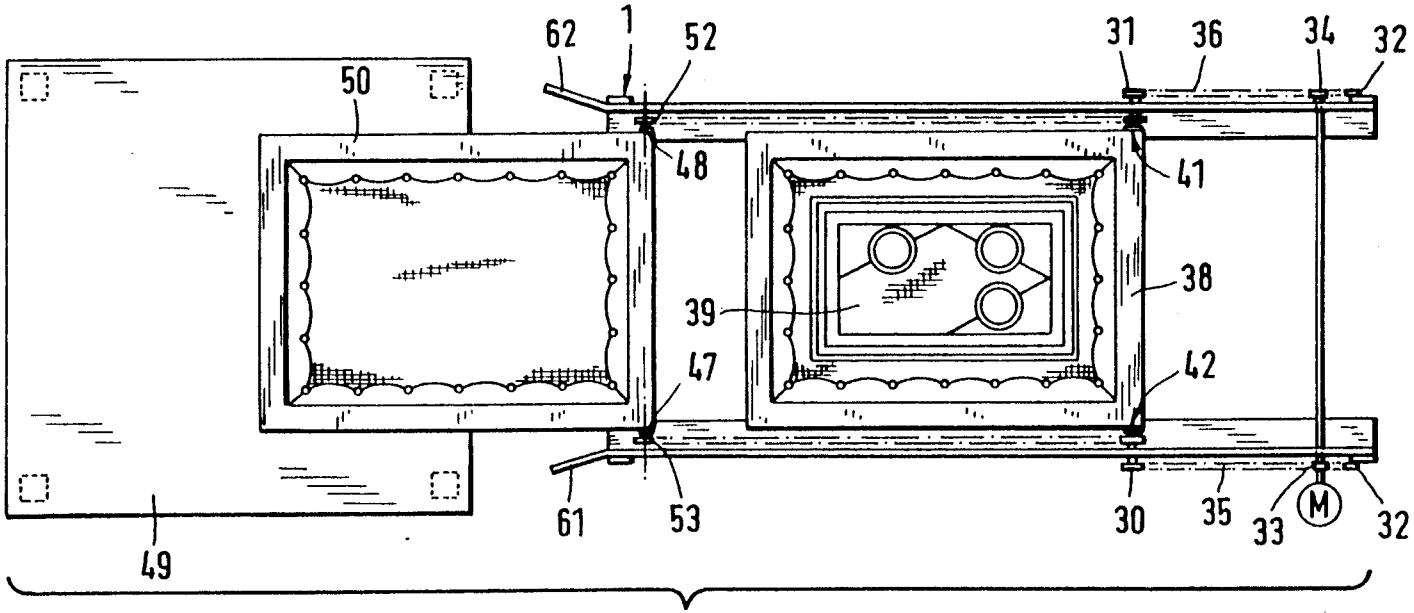
FIG. 4 is a topview relating to FIG. 3.

The operation of the described equipment is substantially as follows. While the material in the frame 38 is being sewed, another frame 50 may be fitted with material 51, i.e. latter is clamped in it, and the frame 50 then can be coupled in the position shown in FIGS. 3 and 4. After sewing, the actual sewing machine is moved into the position on the right in FIG. 5. Thereupon the drive for the endless belts 28 and 29 is turned ON and thereby the frame 50 coupled to the upper belt side is pulled into the sloping position. At the same time the frame 38 with the processed material and coupled to the lower belt side is forced out. In the process the drawn-in frame 50 slides by its rear end over the expelled frame 38 until the position shown in FIG. 3 has been reached, whereupon the frame 38 has assumed the position of the frame 50 and the frame 50 the position of the previous frame 38. The frame 50 then is in the operational position and the frame 38 can be released from the coupling means again. The frame can be manually coupled and uncoupled by an operator standing at the end side of the previously described machine.

However the work shall be advantageously made easier by setting up a work bench 49 in front of the sewing-machine structure 1, and in particular with some space between the two. The spacing shall be just such that an operator can move between the sewing-machine structure 1 and the work bench 49. The work bench 49 comprises a planar top plate approximately at the height of the lower displacement plane, that is approximately at the height of the rest surfaces 20, 21 of the frame 38 on the guide rails 18, 19 in the sewing-machine structure 1. An essential advantage of the above described frame-exchanging equipment is that the work bench requires no lift or drive means or other machine parts. Another and highly important advantage is that the frame-exchange can be totally automated, i.e., no operator is required to watch the process. Therefore the operator only needs to couple the particular frame to be inserted and later to uncouple the frame with the material having been sewed. Meantime for instance the operator may attend other machinery to carry out other work. Considerably and heretofore typical wait-times are avoided in this manner.

What is claimed is:

1. A sewing machine for large surfaced material comprising means for sewing upon relatively large surfaced material, means for effecting longitudinal and transverse displacement of said sewing means, a pair of endless conveyors disposed in general side-by-side relationship, each of said pair of conveyors being defined by upper and lower generally parallel conveyor runs and opposite bight conveyor runs therebetween, a sewing zone being located generally between said opposite bight conveyor runs, a loading zone being disposed generally outside of said sewing zone, said pair of endless conveyors each having first and second coupling means for selectively coupling and uncoupling with respect to third and fourth coupling means of respective first and second frames, said first and second frames each being adapted to hold respective first and second relatively large surfaced material which is sewn in said sewing zone by said sewing means, said first and second coupling means being spaced a maximum distance between each other as measured in predetermined opposite directions of conveyor runs travel, said maximum distance between said first and second coupling means being at least equal to one linear dimension of said frames, and means for selectively simultaneously driving said pair of endless conveyors to simultaneously move one of said frames from said loading zone in a first direction of travel established by a first portion of each of said pair of said conveyors while simultaneously moving the other of said frames from said sewing zone to said loading zone in a second direction of travel established by a second portion of each of said pair of said conveyors opposite to said first direction.

2. The sewing machine as defined in claim 1 wherein said first and second portions of said pair of said conveyors are respectively said upper and lower conveyor runs.

3. The sewing machine as defined in claim 1 wherein said lower conveyor runs are disposed generally in said sewing zone whereby the relatively large surfaced material of the frame within said sewing zone is sewn by said sewing means.

4. The sewing machine as defined in claim 1 wherein said driving means is constructed and arranged for maintaining said pair of endless conveyors generally motionless during the performance of a sewing operation by said sewing means.

5. The sewing machine as defined in claim 1 wherein one of both said first and second coupling means and said third and fourth coupling means are projecting members, and the other of both said first and second coupling means and said third and fourth coupling means are constructed and arranged to couple with and uncouple from said projecting members.

6. The sewing machine as defined in claim 1 wherein said first and second coupling means are defined by projecting members, and said third and fourth coupling means are constructed and arranged to couple with and uncouple from said projecting members.

7. The sewing machine as defined in claim 1 wherein said first and second coupling means are each defined by members which project toward each other, and said third and fourth coupling means are constructed and arranged to couple with and uncouple from said projecting members.

8. The sewing machine as defined in claim 1 wherein at least one of said first, second, third and fourth coupling means are magnetic.

9. The sewing machine as defined in claim 1 wherein at least one of said first, second, third and fourth coupling means are snap locking.

10. The sewing machine as defined in claim 1 wherein each frame includes generally spaced parallel longitudinal sides and transverse ends defining two pairs of transversely opposite corners, and said third and fourth coupling means are located at one of said two pairs of corners of said respective first and second frames.

11. The sewing machine as defined in claim 1 wherein each frame includes generally spaced parallel longitudinal sides and transverse ends defining two pairs of transversely opposite corners, and said third and fourth coupling means are located at one of said two pairs of corners of said respective first and second frames generally along the longitudinal sides thereof.

12. The sewing machine as defined in claim 1 including guide means for guiding the movement of at least one of said first and second frames during the movement thereof.

13. The sewing machine as defined in claim 1 wherein said first and second portions of said pair of said conveyors are respectively said upper and lower conveyor runs, and guide means for guiding the movement of said first and second frames during the movement thereof by said lower conveyor run.

14. The sewing machine as defined in claim 1 wherein said first and second portions of said pair of said conveyors are respectively said upper and lower conveyor runs, and guide means for guiding the movement of said first and second frames only during the movement thereof by said lower conveyor run.

15. The sewing machine as defined in claim 1 including guide means for guiding the movement of at least one of said first and second frames during the movement thereof, and said guide means are defined by opposite transversely spaced and opposing and longitudinally extending guide rails.

16. The sewing machine as defined in claim 1 including guide means for guiding the movement of at least one of said first and second frames during the movement thereof, said guide means are defined by opposite transversely spaced and opposing and longitudinally extending guide rails, said guide rails each are of an L-shaped cross-sectional configuration defined by a horizontal leg and a vertical leg, rotating means about which said endless conveyors are entrained, and said rotating means are supported by said vertical legs.

17. The sewing machine as defined in claim 1 wherein a first of said opposite bight conveyor runs is positioned adjacent said loading zone and a second of said opposite bight conveyor runs is positioned remote from said loading zone, and said first and second coupling means are located at said first and second bight conveyor runs during the performance of a sewing operation by said sewing means.

18. The sewing machine as defined in claim 1 wherein a first of said opposite bight conveyor runs is positioned adjacent said loading zone and a second of said opposite bight conveyor runs is positioned remote from said loading zone, said first and second coupling means are located at said first and second bight conveyor runs during the performance of a sewing operation by said sewing means, and said first coupling means is located at an elevation above that of said second coupling means.

19. The sewing machine as defined in claim 1 wherein a first of said opposite bight conveyor runs is positioned adjacent said loading zone and a second of said opposite bight conveyor runs is positioned remote from said loading zone, said first and second coupling means are located at said first and second bight conveyor runs during the performance of a sewing operation by said sewing means, said first coupling means is located at an elevation above that of said second coupling means, and means at said loading zone for supporting a frame below said elevation whereby such frame when coupled to said first coupling means defines a shallow angle with the horizontal during the performance of a sewing operation by said sewing means.

20. The sewing machine as defined in claim 1 wherein the opposite directions of conveyor runs travel are such as to pull frames from said loading zone by said first conveyor run into said sewing zone and push frames from said sewing zone by said second conveyor run into said loading zone.

21. The sewing machine as defined in claim 1 including guide means for guiding the movement of at least one of said first and second frames during the movement thereof, and means for adjusting a transverse distance between said guide means.

22. The sewing machine as defined in claim 1 including guide means for guiding the movement of at least one of said first and second frames during the movement thereof from said loading zone.

23. The sewing machine as defined in claim 2 including guide means for guiding the movement of at least one of said first and second frames during the movement thereof.

24. The sewing machine as defined in claim 2 wherein a first of said opposite bight conveyor runs is positioned adjacent said loading zone and a second of said opposite bight conveyor runs is positioned remote from said loading zone, and said first and second coupling means are located at said first and second bight conveyor runs during the performance of a sewing operation by said sewing means.

25. The sewing machine as defined in claim 2 wherein a first of said opposite bight conveyor runs is positioned adjacent said loading zone and a second of said opposite bight conveyor runs is positioned remote from said loading zone, said first and second coupling means are located at said first and second bight conveyor runs during the performance of a sewing operation by said sewing means, and said first coupling means is located at an elevation above that of said second coupling means.

26. The sewing machine as defined in claim 3 including guide means for guiding the movement of at least one of said first and second frames during the movement thereof.

27. The sewing machine as defined in claim 3 wherein a first of said opposite bight conveyor runs is positioned adjacent said loading zone and a second of said opposite bight conveyor runs is positioned remote from said loading zone, and said first and second coupling means are located at said first and second bight conveyor runs during the performance of a sewing operation by said sewing means.

28. The sewing machine as defined in claim 3 wherein a first of said opposite bight conveyor runs is positioned adjacent said loading zone and a second of said opposite bight conveyor runs is positioned remote from said loading zone, said first and second coupling means are located at said first and second bight conveyor runs during the performance of a sewing operation by said sewing means, and said first coupling means is located at an elevation above that of said second coupling means.

29. The sewing machine as defined in claim 4 including guide means for guiding the movement of at least one of said first and second frames during the movement thereof.

30. The sewing machine as defined in claim 4 wherein a first of said opposite bight conveyor runs is positioned adjacent said loading zone and a second of said opposite bight conveyor runs is positioned remote from said loading zone, and said first and second coupling means are located at said first and second bight conveyor runs during the performance of a sewing operation by said sewing means.

31. The sewing machine as defined in claim 4 wherein a first of said opposite bight conveyor runs is positioned adjacent said loading zone and a second of said opposite bight conveyor runs is positioned remote from said loading zone, said first and second coupling means are located at said first and second bight conveyor runs during the performance of a sewing operation by said sewing means, and said first coupling means is located at an elevation above that of said second coupling means.

j

* * * * *